US009162092B2

(12) United States Patent
Ostrobrod

(10) Patent No.: US 9,162,092 B2
(45) Date of Patent: Oct. 20, 2015

(54) HORIZONTAL LIFELINE TRAVERSING DEVICE

(71) Applicant: Meyer Ostrobrod, Philadelphia, PA (US)

(72) Inventor: Meyer Ostrobrod, Philadelphia, PA (US)

( * ) Notice: Subject to any disclaimer, the term of this patent is extended or adjusted under 35 U.S.C. 154(b) by 58 days.

(21) Appl. No.: 14/014,591

(22) Filed: Aug. 30, 2013

(65) Prior Publication Data

US 2015/0060197 A1 Mar. 5, 2015

(51) Int. Cl.
*A62B 35/00* (2006.01)

(52) U.S. Cl.
CPC ..... *A62B 35/0081* (2013.01); *A62B 35/0087* (2013.01)

(58) Field of Classification Search
CPC ..... A62B 35/0087; A62B 35/0081
See application file for complete search history.

(56) References Cited

U.S. PATENT DOCUMENTS

| | | | | |
|---|---|---|---|---|
| 4,462,316 | A * | 7/1984 | Tupper | 105/151 |
| 4,521,000 | A * | 6/1985 | Dodge, Jr. | 254/391 |
| 5,245,931 | A | 9/1993 | Cuny | |
| 6,125,766 | A | 10/2000 | Flux | |
| 6,311,625 | B1 | 11/2001 | Ostrobrod | |
| 6,412,420 | B1 * | 7/2002 | Kramer et al. | 104/182 |
| 6,640,727 | B2 | 11/2003 | Ostrobrod | |
| 6,776,103 | B2 * | 8/2004 | Simard et al. | 104/112 |
| 6,945,357 | B1 | 9/2005 | Flux | |

* cited by examiner

*Primary Examiner* — Alvin Chin-Shue
(74) *Attorney, Agent, or Firm* — Norman E. Lehrer

(57) ABSTRACT

A horizontal lifeline traversing device is capable of traversing intermediate lifeline supports without detachment from the lifeline but is easily attached to or detached from the lifeline. A paddle wheel having a plurality of radially spaced apart paddles prevents the device from vertical movement. The paddles are made of first and second sets of paddles rotatable about the same axle. The first set is substantially fixed on the axle but the second set is movable axially between a first position where it is axially spaced from the first set and a second position where it is in substantial axial alignment with the first set. A spiral spring biases the second set into the first position. By rotating the second set of paddles slightly, it can be moved axially into the second position where the device can be attached to or detached from a horizontal lifeline.

3 Claims, 4 Drawing Sheets

HORIZONTAL LIFELINE TRAVERSING DEVICE

BACKGROUND OF THE INVENTION

The present invention is directed toward a safety apparatus and more particularly toward a safety apparatus in the form of a load attachment system such as commonly used as a horizontal lifeline. The invention includes a load attachment traversing device that engages the lifeline for movement thereallong and which can traverse intermediate supports without detachment from the line. More significantly, the load attachment traversing device can be easily attached to or removed from the horizontal lifeline while the lifeline is in place and without having to detach any part of the lifeline from its supports.

Horizontal lifelines have been employed for many years to provide fall protection for workers on elevated structures. In fact, such horizontal lifelines are required and have been mandated by safety rules and regulations in many jurisdictions. Such lifelines normally consist of a rope or cable suspended between two structures such as the vertical beams of a building or the like which may be 10, 20 or even 100 feet apart. A safety harness or safety belt is worn by a worker and a lanyard connected to the harness or belt attaches to the horizontal lifeline or cable. The end of the lanyard may include either a loop which can freely move along the length of the lifeline or it may include a grooved roller in the form of a pulley or the like that rolls along the line. This allows the worker to move freely along the length of the lifeline to accomplish his intended tasks. In the event that the worker losses his footing or otherwise falls, the horizontal lifeline, through the lanyard and harness or safety belt will arrest the fall and prevent the worker from suffering injury. The use of such a lifeline is described, for example, in U.S. Pat. Nos. 5,332,071; 5,458,214 and 5,598,900.

In order to function properly, the horizontal lifeline must be sufficiently taught so that the worker's lanyard can easily move across the same and so that the lifeline can function as a steadying rail for the worker, if necessary. However, when the lifeline is sufficiently taught so that the same assumes a linear or substantial linear configuration, the resistance force magnitude required to effectively withstand the load impact of a falling worker becomes theoretically exceedingly large. In the event of a fall, the construction worker ordinarily generates many times his weight in the impact force exerted by the lanyard against the cable or lifeline. Thus, the tension in the lifeline is critical since this determines the amount of sag in a lifeline which, in turn, determines the load amplification by which a vertical fall arrest force applied to the lifeline is multiplied by. Therefore, it is important to know the amount of tension applied to a lifeline. In fact, the amount of tension is frequently dictated by safety rules or regulations in many jurisdictions.

A winch or similar type device is frequently used to tension a horizontal lifeline when the same is in use. The lifeline is normally connected to one anchoring point and then passes through the winch. The winch, in turn, is connected through an anchoring line to the second anchor point. A winch-like device for tightening a horizontal lifeline is described, for example in U.S. Pat. No. 5,957,432 issued to the present applicant, the subject matter of which is incorporated by reference herein.

On short runs of 10 or 20 feet or so, the horizontal lifeline is normally supported only at the ends thereof. With substantially longer runs, however, it frequently becomes necessary to provide intermediate supports to prevent the line from sagging. This creates problems when a worker is attempting to move along the length of the line as the intermediate supports will prevent the loop or pulley at the end of his lanyard from passing. Thus, it would become necessary for the worker to detach his lanyard, move the same to the other side of the intermediate support and then reattach it again. This obviously creates a significant safety hazard.

Devices have been available and proposed in the past which are capable of traversing the intermediate supports. One such device, sold under the name Transfastener by Hy-SafeTechnology, of Silver Lake, Wis., is produced by Latchways Ltd., of Wiltshire, England. Similar devices are shown, for example, in U.S. Pat. Nos. 1,122,024; 1,429,007; 4,265,179; 4,462,316 and 4,470,354.

Each of these devices is comprised essentially of an upper portion and a lower portion where one of them is essentially in the form of a rotatable star wheel or the like and the other includes a track adapted to cooperate with the ends of the star wheel. As the device moves along a line, the star wheel is caused to rotate when it engages an intermediate support and the ends of the star wheel roll or slide across a track on the second portion of the device. It is, therefore, the interaction between the ends of the star wheel and the track on the second member which must support the weight should a worker fall or in the event that loads are being transported by the device. This can create excessive wear and ultimately possible failure which could create a safety hazard. In addition, because of the tolerances that are required in ensuring that the ends of the star wheel properly meet with the second portion of the device, these products can be expensive to produce and maintain.

Applicant overcame many of the foregoing problems with the improved horizontal lifeline traversing device described in his U.S. Pat. Nos. 6,311,625 and 6,640,727 the subject matter of which is incorporated herein by reference. The system described in those patents includes a load attachment device having a pair of grooved rollers that rides on the lifeline. A load is supported from the bottom of a C-shaped member which has its top connected to the rollers thereby allowing the device to traverse the supports. The bottom of the C-shaped member also carries a rotatable paddle wheel which prevents the device from being removed from the line. The paddle wheel rotates when a paddle is engaged by the support's horizontal bar as the device traverses the support.

Although Applicant's patented device is an improvement over the prior art, it still had one drawback that it shared with similar prior art systems. In order to attach the device to the horizontal lifeline, it was necessary to remove one end of the lifeline from its support so that it could be passed through the traversing device. Similarly, when it was desired to remove the device from the lifeline, an end of the lifeline again had to be removed from its support.

While devices have proposed that can allegedly be attached to and detached from a horizontal lifeline while it remains in place, Applicant is not aware of any that have been successful. See, for example, U.S. Pat. Nos. 5,245,931; 6,125,766 and 6,945,357. These are either too cumbersome or difficult to maneuver into position or simply do not function as intended. There is, therefore, a need for a load attachment traversing device that can be easily attached to or removed from a horizontal lifeline while the lifeline is in place and without having to detach any part of the lifeline from its supports

SUMMARY OF THE INVENTION

The present invention is designed to overcome the deficiencies of the prior art discussed above. Accordingly, it is an object of the present invention to provide a load attachment traversing device that can be easily attached to a horizontal lifeline while the lifeline is in place and without having to detach any part of the lifeline from its supports.

It is a further object of the present invention to provide a load attachment traversing device that can be easily removed from a horizontal lifeline while the lifeline is in place and without having to detach any part of the lifeline from its supports.

It is a still further object of the invention to provide a load attachment traversing device that can be easily attached to or removed from a horizontal lifeline and which cannot inadvertently leave the lifeline but which can traverse intermediate supports for the lifeline In accordance with the illustrative embodiments demonstrating features and advantages of the present invention, there is provided a horizontal lifeline traversing device which is capable of traversing intermediate lifeline support members without detachment from said lifeline but which can be easily attached to or detached from an existing horizontal lifeline. The device includes a paddle wheel having a plurality of radially spaced apart paddles that prevents the device from vertical movement to maintain it on the lifeline. The paddles are made of first and second sets of paddles rotatable about the same axle. While the first set of paddles is substantially fixed on the axle, the second set is movable axially on the axle between a first position where it is axially spaced from the first set and a second position where it is in substantial axial alignment with the first set. A spiral spring biases the second set of paddles into the first position. By rotating the second set of paddles slightly, it can be moved axially into the second position where the device can be attached to or detached from a horizontal lifeline.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
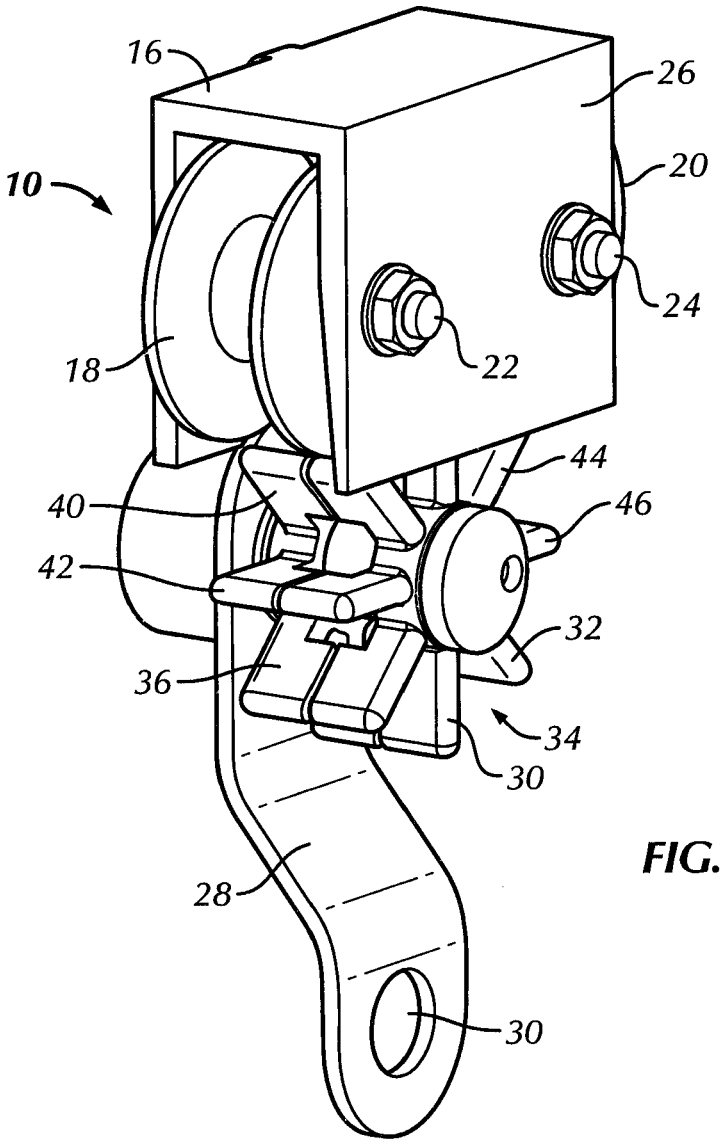
FIG. 1 is a front top perspective view of the improved horizontal lifeline traversing device of the invention.

Referring now to the drawings in detail wherein like reference numerals have been used throughout the various figures to designate like elements, there is shown in each of the figures an improved horizontal lifeline traversing device constructed in accordance with the principals of the present invention and designated generally as 10. The device 10 is an improvement on the horizontal lifeline traversing device shown in prior U.S. Pat. Nos. 6,311,625 and 6,640,727 and generally functions in the same manner as described therein. The entire disclosures of both of these patents are incorporated herein by reference.

More particularly, the device 10 traverses a horizontal lifeline 12 connected to a support structure such as a building or the like. The lifeline 12 may be a hundred or even several hundred feet long. In order to prevent the same from sagging, one or more support members are intermediately located between the ends of the lifeline. In most instances, the intermediate support members are comprised of a substantially horizontally oriented bar that underlies the line 12 and provides vertical support for the line. This is explained in detail in the prior referenced patents and one such support bar is shown at 14 in FIG. 8.

The load attachment traversing device 10 is constructed as a truck or trolley type device which is adapted to freely roll on the upper surface of the line 12. The device is comprised of a frame member 16 which supports a pair of spaced apart grooved rollers 18 and 20 which are arranged in tandem. The grooved rollers 18 and 20 are in the form of pulleys or the like and are freely rotatable about axes 22 and 24 carried by the upper frame member 26.

Extending downwardly from the upper frame member 26 is a lower frame member 28 which has an opening 30 formed at the bottom thereof which allows a workman to attach his lanyard or other load to the same.

Figure 8:
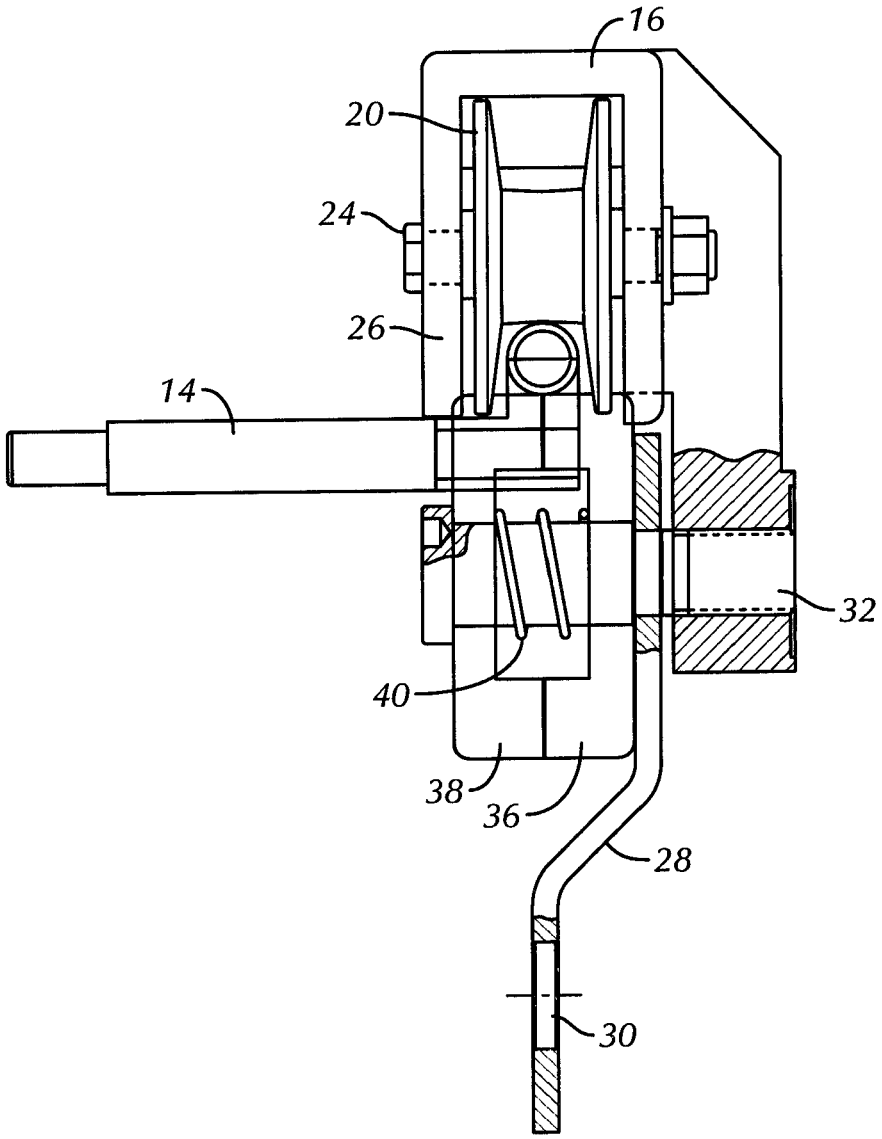
FIG. 8 is a right side elevational end view of the horizontal lifeline traversing device with portions broken away illustrating the internal mechanism of the star wheel.

At the upper end of the lower frame member 28 and freely rotatable about axis 32 is a paddle wheel assembly 34. The paddle wheel assembly 34 allows the load attachment traversing device 10 to freely roll on the line 12 and traverse intermediate supports without detachment from the line 12. As shown in FIG. 8, the line 12 lies between the grooved rollers 18 and 20 and the outer circumference of the paddles of the paddle wheel assembly 34. The details of the arrangement thus far described and the manner in which the traversing device 10 operates are essentially prior art and are fully explained in prior U.S. Pat. Nos. 6,311,625 and 6,640,727. A further description thereof is, therefore, not believed to be necessary.

The present invention solves the problem of attaching the load attachment traversing device 10 to and removing it from the line 12 without having to disconnect the end of the lifeline 12 from the building or other support. This is accomplished by a modification to the paddle wheel assembly 34.

As shown in each of the figures, the paddle wheel assembly 34 is comprised of two substantially identical parts 36 and 38 each representing approximately one half of a paddle wheel. Each of the wheel halves 36 and 38 includes a plurality of sets of paddles such as shown at 40, 42 on wheel half 36 and 44, 46 on wheel half 38. The number of paddles may vary depending on the size of the device 10. It is preferred, however, that the number be chosen whereby at least one and preferably two paddles will always be in a position to prevent the device 10 from inadvertently be lifted up.

The number of paddles on each of the wheel halves 36 and 38 is identical and they are equal angularly spaced about the axis of the wheels. Normally, the paddles on one wheel half will be aligned with the paddles on the other wheel half as shown in FIGS. 1, 2, 7 and 8 so as to appear to be a single paddle. Furthermore, the paddles will normally rotate together as the device 10 traverses an intermediate support 14.

Figures 5, 6, 7:
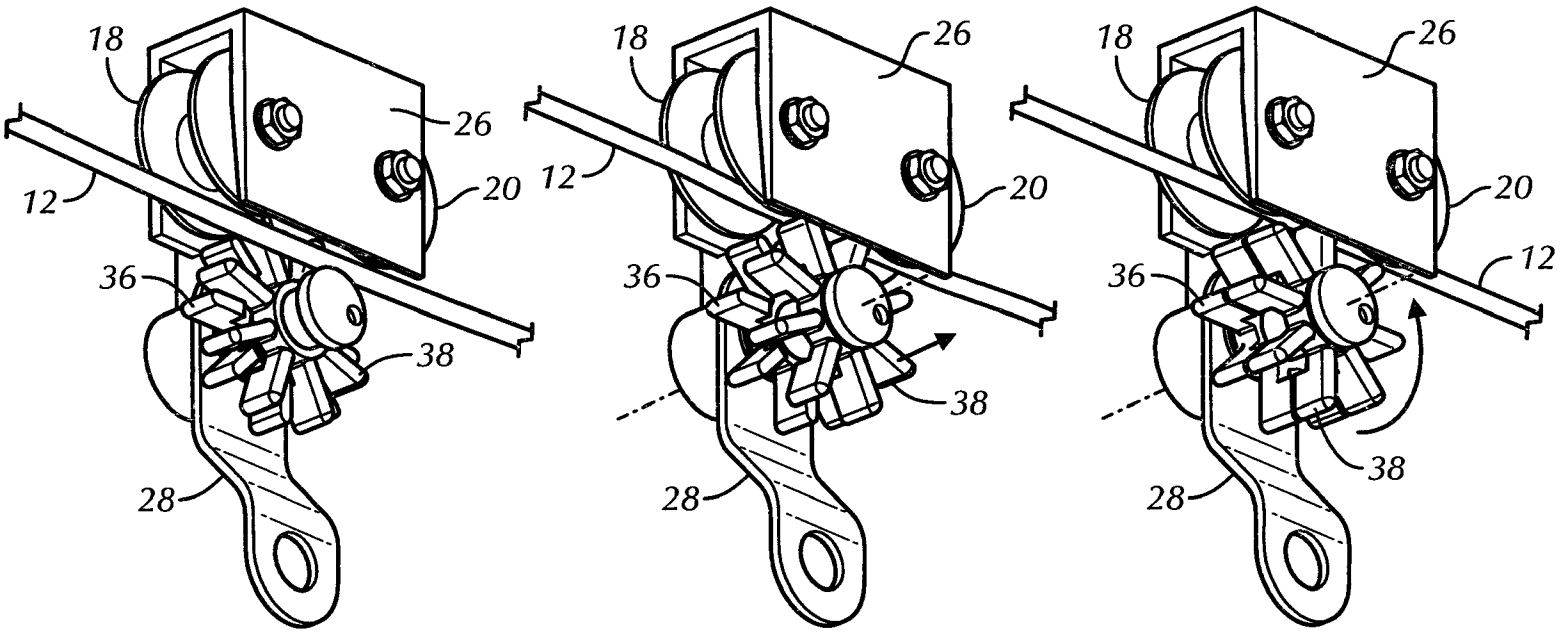
FIGS. 5, 6 and 7 are front bottom perspective views similar to FIGS. 2, 3 and 4 illustrating how the horizontal lifeline traversing device attaches to a lifeline.

Paddle wheel half 36 is fixed on the axle 32 so as to rotate therewith. The second paddle wheel half 38, however, is capable of some rotation relative to the axle and is capable of axial movement. A compression spring 40 surrounding the axle 32 biases the halves 36 and 38 away from each other. By rotating the wheel half 38 slightly until the paddles 44 and 46 thereon are aligned with the openings between the paddles 40 and 42 on wheel half 36, the wheel half 38 can be moved axially toward the wheel half 36 into a second position thereby creating an opening that allows the line 12 to pass up over the wheel half 38 and into the grooves in the rollers 18 and 20. Once the device 10 is in place on the line 12, the wheel half 38 is allowed to return to its first position as shown in FIGS. 1 and 7.

Figure 4:
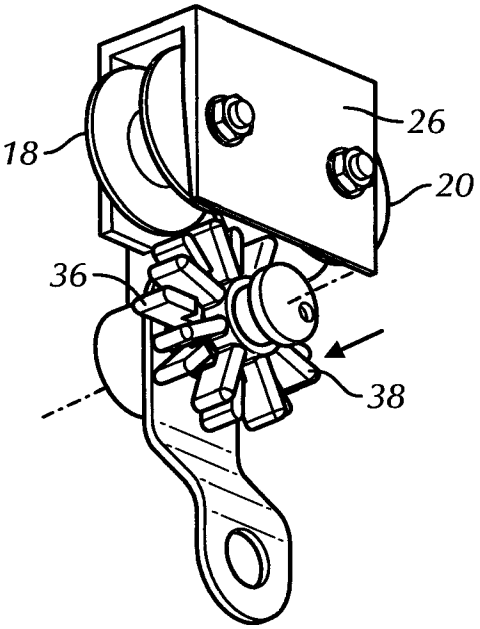
FIGS. 2, 3 and 4 are front bottom perspective views of the improved horizontal lifeline traversing device of the invention illustrating the different positions of the star wheel.
Figure 3:
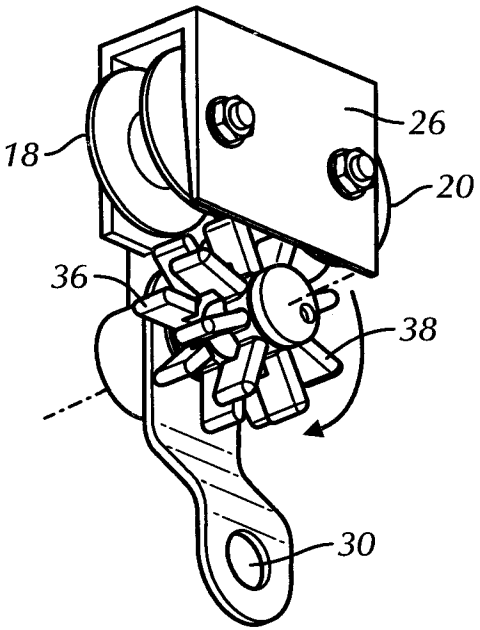
Figure 2:
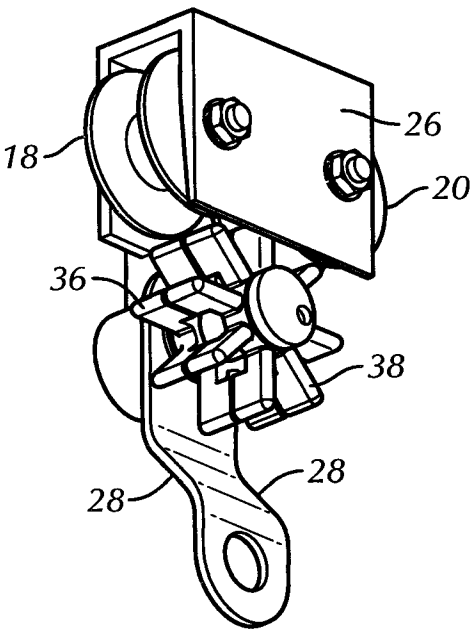

The lifeline traversing device 10 is used in the following manner, reference being made to FIGS. 1-7 in sequence. FIGS. 1 and 2 show the device 10 in its normal state. When it is desired to attach the same to a lifeline, the second paddle wheel half 38 with paddles 44 and 46, etc., is rotated slightly by hand about its axis until the paddles lie between adjacent paddles of the first wheel half 36. In this position, as shown in FIG. 4, the second wheel half 38 can be moved axially toward the first wheel half 36 until the paddles on the second wheel half are in substantial axial alignment with the paddles of the first wheel half. As shown best in FIG. 4, this leaves a gap between the paddles of the second wheel half and the bottom edge of the rollers 18 and 20. As shown best in FIG. 5, this allows the device 10 to be placed over the lifeline 12. Once the lifeline 12 is in place in the grooves of the rollers 18 and 20, the second wheel half 38 moves back outwardly into its first axial position and then rotates slightly so as to again be in alignment with the first wheel half as shown in FIG. 7. Removing the device 10 from the lifeline 12 is accomplished by simply reversing the above steps.

The present invention may be embodied in other specific forms without departing from the spirit or essential attributes thereof and accordingly, reference should be made to the appended claims rather than to the foregoing specification as indicating the scope of the invention.

I claim:

1. In a horizontal lifeline load attachment traversing device which is capable of traversing intermediate lifeline support members which support a horizontal lifeline without detachment from said lifeline, said load attachment traversing device including a grooved roller for engaging the upper surface of said lifeline for rolling movement along the length thereof, a frame having an upper portion secured to said roller and a lower portion including a substantially vertical portion extending downwardly below the level of the lower surface of said lifeline and including a lower arm and means carried by said lower arm for securing a load to said device, and a rotatable member in the form of a paddle wheel having a plurality of radially spaced apart paddles carried by said lower arm for preventing said device from vertical movement so that said device cannot be unintentionally removed from said lifeline, said paddles being adapted to rotate about a horizontal axis when engaged by an intermediate support member, the improvement comprising:

said paddles being comprised of first and second sets of paddles, each set being rotatable about the same axis;

an axle defining said axis;

said first set of paddles being substantially fixed on said axle;

said second set of paddles being capable of some rotation relative to said axle and being movable axially on said axle between a first position wherein it is axially spaced from said first set and a second position where it is in substantial axial alignment with said first set, and whereby said device can be attached to or detached from said horizontal lifeline when said second set of paddles is in said second position.

2. The improvement as claimed in claim 1 including means biasing said second set of paddles into said first position.

3. The improvement as claimed in claim 1 wherein said first and second sets of paddles and said axle are so arranged that said second set of paddles must be rotated about said axle slightly before it can be moved axially into said second position.

* * * * *